US010294073B2

(12) United States Patent
Haapaniemi et al.

(10) Patent No.: US 10,294,073 B2
(45) Date of Patent: May 21, 2019

(54) ELEVATOR PROVIDED WITH A SAFETY APPARATUS ARRANGEMENT, AND A SAFETY APPARATUS

(71) Applicants: Markku Haapaniemi, Helsinki (FI); Matti Rasanen, Hyvinkaa (FI); Markku Haivala, Hyvinkaa (FI); Ari Kattainen, Hyvinkaa (FI)

(72) Inventors: Markku Haapaniemi, Helsinki (FI); Matti Rasanen, Hyvinkaa (FI); Markku Haivala, Hyvinkaa (FI); Ari Kattainen, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 279 days.

(21) Appl. No.: 15/211,067

(22) Filed: Jul. 15, 2016

(65) Prior Publication Data

US 2016/0325964 A1 Nov. 10, 2016

Related U.S. Application Data

(63) Continuation of application No. PCT/FI2014/050977, filed on Dec. 10, 2014.

(30) Foreign Application Priority Data

Jan. 21, 2014 (FI) ..... 20145056

(51) Int. Cl.
*B66B 5/00* (2006.01)
*B66B 5/22* (2006.01)
(Continued)

(52) U.S. Cl.
CPC ..... *B66B 5/005* (2013.01); *B66B 5/0062* (2013.01); *B66B 5/0068* (2013.01); *B66B 5/22* (2013.01); *B66B 5/044* (2013.01); *B66B 5/16* (2013.01)

(58) Field of Classification Search
CPC ..... B66B 5/005; B66B 5/0062; B66B 5/0068; B66B 5/22; B66B 5/044; B66B 5/16
See application file for complete search history.

(56) References Cited

U.S. PATENT DOCUMENTS 1,143,017 A 6/1915 Andrews, Jr.
1,314,228 A 8/1919 Turgeon
(Continued)

FOREIGN PATENT DOCUMENTS

EP 1 674 416 A1 6/2006
EP 2 060 528 A1 5/2009
(Continued)

OTHER PUBLICATIONS

Finnish Search Report #20145056, dated Sep. 25, 2014.
(Continued)

*Primary Examiner* — Michael A Riegelman
(74) *Attorney, Agent, or Firm* — Harness, Dickey & Pierce, P.L.C.

(57) ABSTRACT

The object of the invention is an elevator provided with a safety apparatus arrangement, which elevator comprises at least an elevator car traveling along guide rails and a safety brake device, such as a safety gear, for stopping undesired movement of the elevator car, as well as a transmission mechanism for activating the safety gear. The safety apparatus arrangement comprises a tuning apparatus disposed on the elevator car for detecting a presence on the roof of the elevator car, which tuning apparatus comprises means for pre-activating the transmission mechanism when a presence on the roof of the elevator car has been detected.

20 Claims, 3 Drawing Sheets

Figure 1:
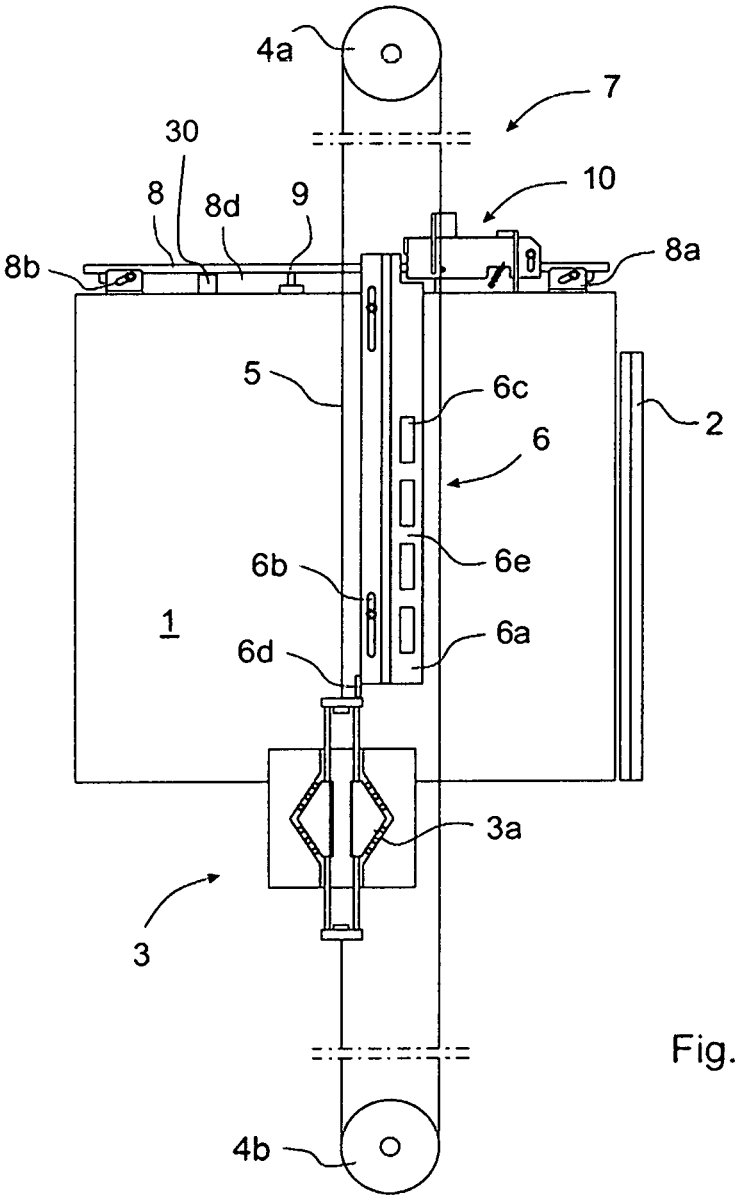

(51) Int. Cl.
*B66B 5/16* (2006.01)
*B66B 5/04* (2006.01)

(56) References Cited

U.S. PATENT DOCUMENTS 7,278,517 B2 * 10/2007 Gut ..... B66B 5/005 187/300
7,523,809 B2 4/2009 Monzon-Simon et al.
8,708,106 B2 * 4/2014 Rasanen ..... B66B 5/005 187/302
8,770,349 B2 7/2014 Madar
2008/0245619 A1 * 10/2008 Monzon-Simon .... B66B 5/0056 187/393
2010/0163346 A1 * 7/2010 Coquerelle ..... B66B 5/0068 187/247
2010/0200339 A1 * 8/2010 Henseler ..... B66B 5/005 187/401
2011/0155510 A1 * 6/2011 Lindberg ..... B66B 5/005 187/314
2011/0240413 A1 10/2011 Madar
2012/0006631 A1 * 1/2012 Ueda ..... B66B 5/0062 187/393
2013/0043098 A1 * 2/2013 Baltisser ..... B66B 5/0056 187/401
2015/0225207 A1 * 8/2015 Minatta ..... B66B 19/00 187/377
2016/0107862 A1 * 4/2016 Kattainen ..... B66B 5/0031 187/247
2016/0325965 A1 * 11/2016 Haapaniemi ..... B66B 5/0062

FOREIGN PATENT DOCUMENTS

GB 2379654 A 3/2003
JP S63288885 A 11/1988
JP 2009067493 A 4/2009
WO WO-2005105645 A1 11/2005
WO WO-2006035264 A1 4/2006
WO WO-2008/004021 A1 1/2008
WO WO-2008081074 A1 7/2008
WO WO-2010122211 A1 10/2010
WO WO-2011030325 A1 3/2011

OTHER PUBLICATIONS

International Search Report PCT/ISA/210 for International Application No. PCT/FI2014/050977 dated Jun. 9, 2015.
Written Opinion of the International Searching Authority PCT/ISA/237 for International Application No. PCT/FI2014/050977 dated Jun. 9, 2015.
Extended European Search Report issued by the European Patent Office for Application No. EP 14 87 9359.

* cited by examiner

ELEVATOR PROVIDED WITH A SAFETY APPARATUS ARRANGEMENT, AND A SAFETY APPARATUS

This application is a continuation of PCT International Application No. PCT/FI2014/050977 which has an International filing date of Dec. 10, 2014, and which claims priority to Finnish patent application number 20145056 filed Jan. 21, 2014, the entire contents of both of which are incorporated herein by reference.

The object of the invention is an elevator, as defined in the preamble of claim 1, provided with a safety apparatus arrangement. The object of the invention is also a safety apparatus as defined in the preamble of claim 11.

When various procedures, such as e.g. inspection, adjustment, servicing or repair procedures, are performed in an elevator hoistway, the safety of personnel that are in the elevator hoistway must always be ensured. Particularly if the elevator car is near the base of the elevator hoistway when an employee is on the base of the elevator hoistway, or if the elevator car is near the top end of the elevator hoistway when an employee is on the roof of the elevator car, unexpected movement of the car can cause a dangerous situation. The size of the safe working space, i.e. the distance of the elevator car from the bottom end or from the top end of the elevator hoistway, is also defined in elevator regulations.

If the height of the bottom clearance or of the top clearance of the elevator hoistway is shallow, sufficient safety spaces for personnel working on the base of the elevator hoistway or on the roof of the elevator car, said safety spaces preventing personal injuries occurring, cannot be guaranteed without special procedures.

In this case movement of the elevator car and of the counterweight must be prevented in some other way than by means of the operating brakes of the elevator. It is known that this can be performed by locking the elevator car and/or the counterweight into their positions on the guide rail e.g. by means of a safety gear, a latch or wedges. This is, however, awkward, laborious and time-consuming, and necessitates working beforehand in the elevator hoistway. Another prior-art solution is to fix a rope clamp to the hoisting roping, by means of which rope clamp the hoisting roping is bound fast to e.g. the overhead beam of the hoistway. This is also, however, an awkward and time-consuming solution and requires special tools.

For example, known in the art are safety solutions in which one or more turnable buffers are disposed below the elevator car or counterweight, which buffer(s) is/are lifted upright before going below the elevator car onto the roof of the elevator car to work. The length of the buffers is such that the movement of the counterweight, and at the same time the movement of the elevator car, stops before the elevator car descends too far down with respect to the base of the hoistway or rises too high with respect to the roof of the elevator hoistway. One problem, among others, in these solutions is, however, that the hoistway space might have been dimensioned so precisely that there is no proper space in the bottom part of the elevator hoistway for turnable safety buffers. Another problem is that if the aforementioned buffers ensuring a sufficient top safety space are in the bottom part of the elevator hoistway, installing the buffers into the safe position takes extra time, and it might also happen that for this reason they are not visited beforehand to install them into the safe position, in which case the safety of people working on the roof of the elevator car is not ensured.

If, on the other hand, the turnable safety buffers are in the top part of the elevator hoistway, that also can cause situations in which a person could not, or did not remember to, go and turn the buffers into the safe position before working on the roof of the elevator car or on the base of the hoistway is started. This situation also exposes people working on the roof of the elevator car or on the base of the hoistway to danger.

In addition to the aforementioned, the safety solutions are often based on electrical supervisions installed in the doors of the hoistway, which supervisions must be switched to the safe position before going onto the roof of the elevator car. Turning the buffers into the safe position and activation of the electrical supervision circuits are often such a complex combination that, particularly e.g. with small tasks, they might be left undone owing to their complexity and to the saving of used time. In addition, electrical monitoring systems are susceptible to failure.

The purpose of this invention is to eliminate the aforementioned drawbacks and to achieve an elevator provided with a safety apparatus arrangement comprising a top safety device and a bottom safety device, wherein the safety apparatus arrangement is easy-to-use and time-saving as well as operationally reliable, and wherein the locking preventing movement of the elevator car can be automatically implemented in both directions of travel without separate complex and time-consuming procedures. The elevator, according to the invention, provided with a safety apparatus arrangement is characterized by what is disclosed in the characterization part of claim 1. The safety apparatus according to the invention is characterized by what is disclosed in the characterization part of claim 11. Other embodiments of the invention are characterized by what is disclosed in the other claims.

Advantageous and dependable ways for bringing about a safe space above the elevator car are achieved with the invention. Preferably the safe space to be formed by means of the invention is applicable to and sufficient for performing servicing tasks and other procedures to be carried out from the roof of the elevator car.

Preferably the invention is expressed as an elevator provided with a safety device arrangement, which elevator comprises at least an elevator car traveling along guide rails and a safety brake device for stopping unintended movement of the elevator car and a transmission mechanism for activating the safety brake device, which safety device arrangement comprises a tuning apparatus disposed on the elevator car for detecting a presence on the roof of the elevator car, and the tuning apparatus comprises means for pre-activating the transmission mechanism in a situation in which a presence has been detected on the roof of the elevator car. A safety brake device that is particularly suitable for use in connection with the invention is a bidirectional safety gear.

Preferably the invention is expressed as a safety apparatus of an elevator, wherein a tuning apparatus is disposed on the elevator car for detecting a presence on the roof of the elevator car and this tuning apparatus comprises means for pre-activating a transmission mechanism owing to a presence on the roof of the elevator car.

Preferably in the tuning apparatus or in the means for detecting a presence on the roof, a horizontal movement is formed in the transmission mechanism as a result of a presence on the roof, which movement results in preactivation of the transmission mechanism.

Preferably the tuning apparatus to be used in the invention comprises a tread base on top of the roof of the elevator car arranged to be movable by the weight of a person. Preferably a detector of the height position of the tread base is connected to the tread base.

Preferably the invention is implemented with a solution in which the transmission mechanism is adapted to cause the safety gear to operate.

Preferably the transmission mechanism is connected to the elevator car to travel along with the elevator car and to be movable in relation to the elevator car in the movement direction of the elevator car, and the transmission mechanism comprises at least activation means for creating a bottom safety space and an activation surface for creating a top safety space, as well as a free surface for the normal drive mode of the elevator.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

One advantage of the solution according to the invention is that by means of it movement of the elevator car in both directions of travel can be effectively, dependably and safely prevented. Another advantage is that the solution is very easy and quick to use, and it does not necessitate awkward working in the hoistway or preliminary procedures in the top end or bottom end of the elevator hoistway. Another advantage is the improvement in safety compared to conventional solutions, because disconnection of the safety circuit of an elevator and the locking of unintended movement of the elevator car switches on automatically when stepping onto the roof of the elevator car. In this case situations cannot arise where switching the safety circuit on could be forgotten, or where a person could not be bothered to switch it on because of its complexity, e.g. for a short job to be performed on the roof. Another advantage is also that the solution according to the invention also enables types of elevator applications that, for some reason, lack natural top clearances. Another advantage is that the apparatus comprised in the arrangement takes little space. A further advantage is that the solution is inexpensive and simple to implement, particularly when the top safety device is adapted to joint action with the transmission mechanism of the bottom safety device, in which case the number of components needed is less than usual. Another advantage is that the safety circuit according to the invention is easy to reset from the landing after work in the hoistway has ended. Yet another advantage is that e.g. a service visit is speeded up and work efficiency improves. In addition, as a mechanical device the top safety device and bottom safety device according to the invention functions more dependably than a complex electrical safety apparatus. One advantage is also that in low elevators the number of traction belts of a belt-driven elevator can be reduced from two to one as a result of the bidirectional safety gear gripping.

Figure 2:
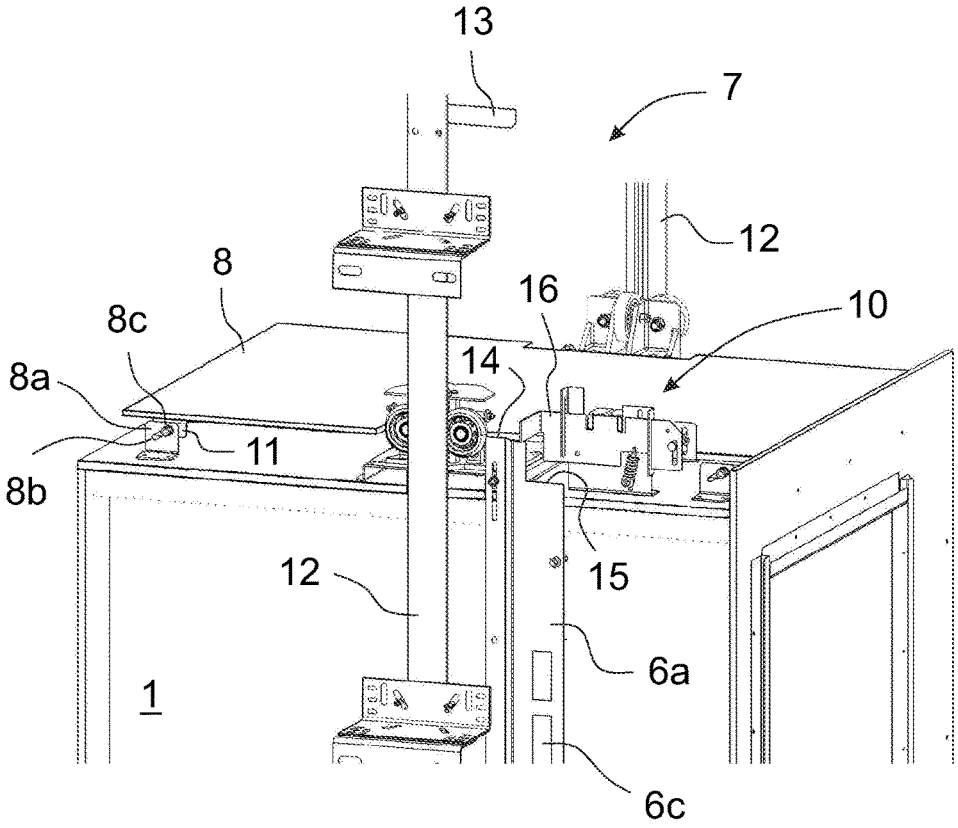
Figure 3:
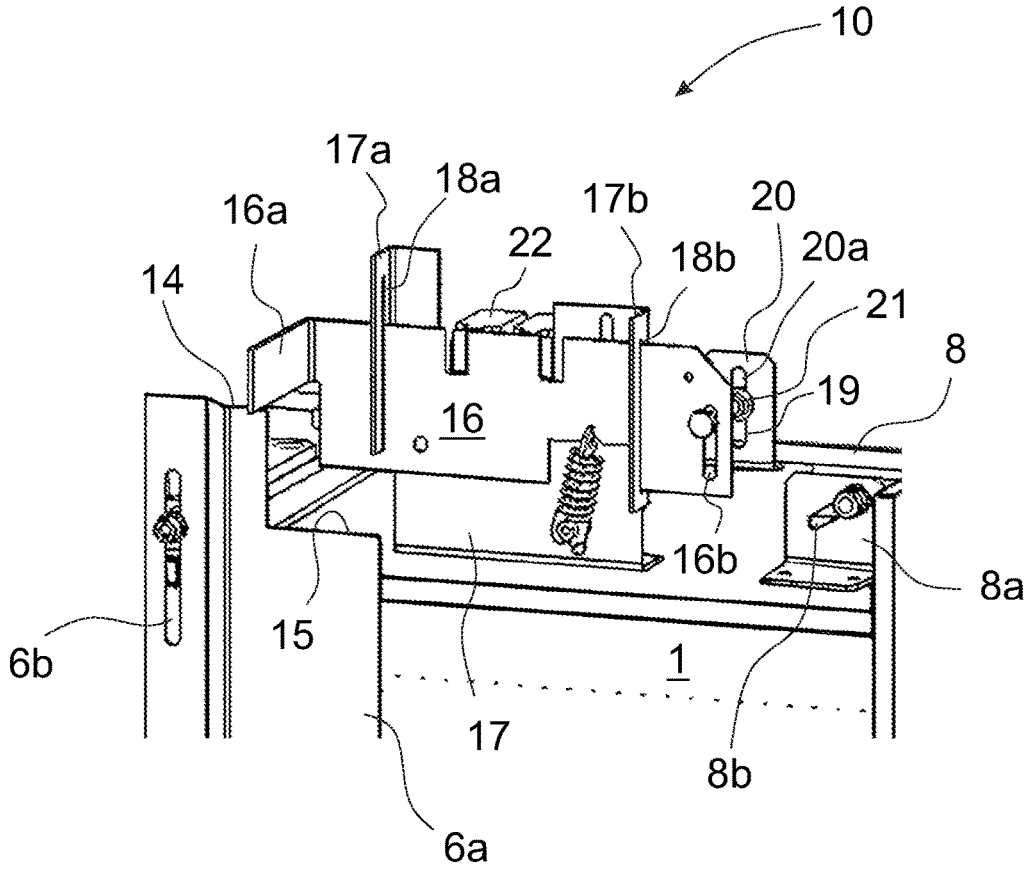

In the following, the invention will be described in detail by the aid of one example of its embodiment with reference to the attached diagrammatic and simplified drawings, wherein FIG. 1 presents a side view of an elevator car, which is provided with one safety apparatus arrangement according to the invention for preventing unintended movement of the elevator car, FIG. 2 presents an oblique view from above of a safety apparatus arrangement according to the invention when connected to the elevator car, and FIG. 3 presents a magnified and oblique view from above of one detail of the safety apparatus arrangement according to FIG. 2.

FIG. 1 presents a simplified side view of an elevator car 1, which is provided with one safety device arrangement according to the invention, for preventing unintended movement of the elevator car 1 and at the same time for creating the sufficiently high upper safety space and lower safety space needed in the elevator hoistway. For the sake of clarity, the guide rails of the elevator car 1 are not presented in FIG. 1.

The elevator car 1 can be a conventional elevator car provided with a car door 2, wherein the rope 5 of the overspeed governor is connected to the wedges 3*a* of a bidirectional safety gear functioning as a safety brake device 3 to stop unintended movement of the elevator car 1, e.g. during normal drive. In the following the shorter designation "safety gear 3" is used to denote the safety brake device 3. On both sides of the elevator car 1 is one safety gear 3, which are connected to each other via a synchronization lever, in which case the wedges 3*a* of both safety gears 3 act in the same way and at the same time.

FIG. 1 presents only a part of the overspeed governor of the elevator car 1, i.e. the rope pulley 4*a* of the overspeed governor in the top end of the elevator hoistway and the diverting pulley 4*b* in the bottom end of the elevator hoistway, as well as the rope 5 of the overspeed governor, between the ends of which rope a lever mechanism moving the wedges 3*a* of the safety gear 3 is connected, which lever mechanism is not however presented in more detail in FIG. 1.

Additionally, FIG. 1 presents a transmission mechanism 6 traveling along with the elevator car 1 and adapted to be movable in the direction of movement of the elevator car in relation to the elevator car, which transmission mechanism is arranged to move the wedges 3*a* of the safety gear 3 to grip the guide rails 12 of the elevator car 1 for stopping the elevator car 1, e.g. during service drive, if the elevator car 1 threatens to go too close to the base or roof of the elevator hoistway. The transmission mechanism 6 in this solution is connected at one of its ends via a coupling member 6*d* directly to a lever mechanism of the wedges 3*a* of the safety gear 3, but it can be connected to the wedges 3*a* of the safety gear 3 also via the rope 5 of the overspeed governor.

What is characteristic to the invention is, inter alia, that the top safety device is connected to the same transmission mechanism 6 as the bottom safety device, in which case the structure is simplified and savings are made in, inter alia, space as well as elevator components.

The creation of a bottom safety space via the transmission mechanism 6 is implemented e.g. in such a way that a bottom safety device provided with a separate lever-type or pin-type safety means is fitted in a hinged manner into connection with the elevator hoistway wall that is against the transmission mechanism 6, which bottom safety device can also be fixed in a hinged manner in another rigid location than the wall, e.g. on a guide rail 12 of the elevator car 1. The transmission mechanism 6 has an elongated, e.g. as viewed from the end, frame part 6*a* made from metal plate bent into a profile shape, which frame part is disposed on the wall of the elevator car 1 in its longitudinal direction with respect to the direction of travel of the elevator car 1. In the frame part 6*a* are installation apertures 6*b* that are elongated in its longitudinal direction, from which apertures the frame part 6*a* is connected to the side wall of the elevator car 1 movably in relation to the elevator car 1 in the direction of travel of the elevator car. Also in the frame part 6*a* is a plurality of apertures 6*c* one below the other, the necks 6*e* between which, said necks functioning as the activation means of the bottom safety space, are arranged to function as detent members of the safety means of the bottom safety space. When creating the bottom safety space, the safety means of the bottom safety device is arranged to be turnable in such a way that when the elevator car 1 is at the height of the safety means of the bottom safety device in the hoistway the free outer end of the safety means extends into the aperture 6*c* of the frame part 6*a* of the transmission mechanism 6 and through said aperture. When the safety means is turned into the aperture 6*c*, it is in its so-called safe position. In which aperture 6*c* the free outer end of the safety means is situated at any given time depends on the location of the elevator car 1 in the elevator hoistway.

If the elevator car 1 moves downwards when the safety member of the lower safety device has been turned into its safe position, the neck 6*e* between the apertures 6*b* of the frame part 6*a* of the transmission mechanism 6 hits the safety means, in which case the movement of the frame part 6*a* in relation to the elevator hoistway stops and the frame part 6*a*, stopped by the safety means, moves relatively upwards with respect to the elevator car 1, in which case the coupling member 6*d* pulls the wedges 3*a* of the safety gear 3 against the guide rails 12, and the unintended movement of the elevator car 1 stops.

According to the invention the creation of the top safety space is implemented as is the creation of the bottom safety space, transmitted by the same transmission mechanism 6. For creating the top safety space the solution according to the invention comprises a tuning apparatus 7, for displacing the wedges 3*a* of the safety gear 3 into such a position that the wedges 3*a* compress the elevator guide rail 12 that is between the wedges 3*a* of the safety gear with a force that prevents unintended movement of the elevator car 1, in this case upwards.

The tuning apparatus 7 comprises at least a plate-like or meshed-plate type tread base 8 arranged movably in the vertical and horizontal direction on fixing lugs 8*a*, which tread base is disposed immediately above the roof of the elevator car 1 to rest supported e.g. on spring means 30, as well as to cover essentially the whole of the roof of the elevator car 1 in such a way that when stepping onto the roof a person must always go onto the tread base 8. Between the top surface of the roof of the elevator car 1 and the bottom surface of the tread base 8 is an air gap 8*d* for enabling vertical movement of the tread base 8. Additionally, between the top surface of the roof of the elevator car 1 and the bottom surface of the tread base 8 is a supervision switch 9 that belongs to the tuning apparatus 7 and that functions as a detector of the position or movement of the tread base 8 and that is connected to the control system of the elevator, which supervision switch is arranged to detect the height position or vertical movement of the tread base 8 and to disconnect the safety circuit of the elevator when the tread base 8 moves a sufficient distance downwards, in which case the elevator cannot be driven. The roller of the supervision switch 9 leans from below on the bottom surface of the tread base 8 and moves the lever of the supervision switch 9 up and down when the tread base 8 moves up and down.

The tuning apparatus 7 also comprises means 10 for pre-activating the transmission mechanism 6 when someone has stepped onto the tread base 8. The means 10, hereinafter preactivation means 10, comprise a lever apparatus, which is arranged to preactivate the transmission mechanism 6 when the tread base 8 is stepped upon and the tread base 8 descends obliquely towards the roof of the elevator car 1.

FIGS. 2 and 3 present in more detail the structure of one top safety device according to the invention. The fixing lugs 8*a* of the tread base 8 are disposed on the roof of the elevator car 1, e.g. at the point of all the corners of the tread base 8, between the top surface of the roof of the elevator car 1 and the bottom surface of the tread base 8. In the fixing lug 8*a* is an elongated installation aperture 8*b* aligned obliquely downwards from above, said installation aperture functioning as a guide groove for the movement of the tread base 8 and into which installation aperture a guide & fixing bolt 8*c* functioning as a slide axis of the tread base 8 is disposed for moving along the installation aperture 8*b*. Correspondingly, on the bottom surface of the tread base 8 are fixing lugs 11, in which is a hole for a guiding & fixing bolt 8*c*. In this way the tread base 8 can move obliquely downwards when a weight comes onto the tread base 8 and, on the other hand, obliquely upwards, by means of the spring force provided by the aforementioned springs 30, when the weight on the tread base 8 is removed.

The preactivation means 10 comprises at least a frame part 17, which is fixed to the roof of the elevator car 1 to the side of the tread base 8, and a pretuning means 16 fitted into the frame part 17, which pretuning means is arranged to move along with the movement of the tread base 8. The frame part 17 is e.g. a structure bent from metal plate having a base part in the direction of the roof of the elevator car and a back part at a right angle to this that extends from the base part straight upwards. The frame part 17 is fixed at its base part to the roof of the elevator car 1. On both side edges of the back part are right-angled bends 17*a* and 17*b*, in which are vertical slots 18*a* and 18*b*, of which the slot 18*a* in the bend 17*a* is open at its bottom end and the slot 18*b* in the bend 17*b* is closed at both its ends.

The pretuning means 16 is a plate-type structure, e.g. a thin metal plate, at the first end of which is a bend 16*a* at a right angle with respect to the rest of the plate and at the second end of which is an essentially vertical elongated hole 16*b*, at the point of and at a horizontal distance from which is the essentially similar elongated hole 20*a* of a fixing lug 20 attached to the tread base 8. A guide bolt 21 is disposed in the holes 16*b* and 20*a*, which guide bolt is arranged to move the pretuning means 16 along with the movement of the tread base 8.

The interpositioning of the pretuning means 16 and the frame part 17 can be conveniently maintained by a spring fixed between them. The spring is disposed in such a way that it tries to return the pretuning means to the standby position, in which force effects are not exerted on the pretuning means by the frame part 6*a* of the transmission mechanism 6 or by the detent 13 fixed to the guide rail.

The guiding of the movement of the pretuning means 16 is implemented with slots the 18*a* and 18*b*, into which the pretuning means 16 is fitted to move. The slot 18*a* nearer the first end of the pretuning means 16 is open at the bottom and extends at its top end to higher than the top edge of the pretuning means 16. In this case the first end of the pretuning means 16 can move in the slot 18*a* both upwards and downwards from its normal position, in addition to a horizontal movement.

At the top end of the frame part 6*a* of the transmission mechanism 6 are two end surfaces 14 and 15 side-by-side at a different height, of which the activation surface 14 is higher than the free surface 15. The bend 16*a* of the pretuning means 16 extends to over the top of both end surfaces 14, 15. The location and height of the surfaces 14 and 15 with respect to the bend 16*a* of the pretuning means 16 is dimensioned to be such that when the tread base 8 is in its top position, the bend 16*a* of the pretuning means 16 is above the free surface 15 and so high from the free surface 15 that the frame part 6*a* of the transmission mechanism 6 can rise upwards in a situation in which the elevator car 1 must be stopped for forming a bottom safety space.

Correspondingly, when the tread base 8 moves owing to a weight coming onto it simultaneously both downwards and in the sideways direction, the tread base 8 simultaneously moves the pretuning means 16 in the slots 18*a* and 18*b* in the horizontal direction pushed by the guide bolt 21 in such a way that the bend 16*a* of the pretuning means 16 is displaced to on top of the activation surface 14 that is situated higher than the transmission mechanism 6, and at the same time to below the detent 13 fixed to the guide rail of the elevator car 1, said detent being on a vertical line above the preactivation means. The detent 13 is situated at a height that enables the formation of a top safety space that is sufficiently high.

If the elevator car 1 now, e.g. in a situation in connection with service drive, in which case one or more persons are on the roof of the elevator car 1, ascends to the bottom limit of the top safety space, the bend 16*a* of the pretuning means that has displaced to on top of the activation surface 14 hits the detent 13, as a consequence of which when the elevator car 1 still tries to ascend, the bend 16*a* stops the movement of the frame part 6*a* of the transmission mechanism 6 ascending along with the elevator car and simultaneously presses the frame part 6*a* of the transmission mechanism 6 downwards in relation to the elevator car 1. In this case frame part 6*a* of the transmission mechanism 6 at the same time displaces the wedges 3*a* of the safety gear 3, via the coupling member 6*d*, to against the guide rails 12 of the elevator car, in which case the movement of the elevator car 1 stops and the elevator car 1 is locked into its position. In this way a sufficiently high top safety space is formed.

It must also be possible to form and ensure a bottom safety space when people are on the roof of the elevator car 1 and the top safety space is activated. Since the frame part 6*a* of the transmission mechanism 6 ascends upwards with respect to the elevator car 1, if the elevator car 1 tries to move to below the top limit of the bottom safety space, the pretuning means 16 must in this type of situation be able to rise upwards because the bend 16*a* of it is on top of the activation surface 14, and not in its normal position on top of the free surface 15, which free surface 15 enables movement of the frame part 6*a* upwards in relation to the elevator car 1. The slot 18*a* in the first bend 17*a* of the frame part 17 enables the first end of the activation means 16 and the bend 16*a* on it to rise upwards, pushed by the frame part 6*a* of the transmission mechanism 6, because the top end of the slot 18*a* is higher than the top edge of the activation means 16 in the slot 18*a* at the point of the slot 18*a*. In this way the formation of a sufficiently high safety space simultaneously in both the top part and in the bottom part of the elevator hoistway is enabled.

In addition to the one or more supervision switches 9 detecting the height position of the tread base 8 comprised in the tuning apparatus 7, the tuning apparatus 7 preferably comprises a plurality of other supervision switches, which are also connected to the control system of the elevator. As stated above, the supervision switch 9 detects the height position of the tread base 8, i.e. that the tread base 8 is up when no people are on the roof and that the tread base 8 is down when people or some other extra weight is on the roof. The location of the pretuning means 16 is monitored by means of supervision switches 22 in such a way that the supervision switches 22 detect when the pretuning means 16 is in the normal drive position, in which case the bend 16*a* of the pretuning means 16 is on top of the free surface 15, or when the pretuning means 16 is in the activation position, in which case the bend 16*a* of the pretuning means 16 is on top of the activation surface 14 and on a vertical line below the detent 13. When the supervision switches 9, 22 detect that the tread base 8 is down and the pretuning means 16 is in the activation position, service drive is permitted. If e.g. the pretuning means 16 is not, for some reason, in the activation position, service drive is not permitted.

Access into the elevator hoistway is monitored with supervision switches in the landing doors, with which switches all the safety switches can also be reset on each landing when people that have been working in the elevator hoistway have exited the hoistway and left the roof of the elevator car. When the person has left the roof of the elevator car 1, the pretuning means 16 is arranged to be returned to normal drive mode automatically as the tread base 8 rises obliquely upwards by means of the spring force produced by the aforementioned springs when the weight is removed from the tread base 8. In this case the pretuning means 16 displaces, pulled by the guide bolt 21, along with the tread base 8 into its normal position and the supervision switch 22 of the pretuning means 16 informs the control system when the normal drive position is reached.

What is characteristic of the solution according to the invention is, inter alia, that in the solution according to the invention is a tuning apparatus 7 disposed on the roof of the elevator car 1, by means of which tuning apparatus the presence of people on the roof is detected and a sufficient top safety space is created for working in the elevator hoistway. The top safety space is created by acting e.g. on the wedges 3*a* of the safety gear 3 functioning as a safety brake device of the elevator in such a way that the safety gear 3 is brought into standby mode by activating the pretuning means 16, when at least one person goes onto the roof of the elevator car 1. Bringing the safety gear 3 into standby mode can be performed mechanically, as in the embodiments described above, or also electrically.

It is obvious to the person skilled in the art that different embodiments of the invention are not only limited to the examples described above, but that they may be varied within the scope of the claims presented below. Thus, for example, instead of a mechanical tuning apparatus, the tuning apparatus can be partly optical, e.g. a light curtain, connected to electrical actuators.

Additionally, it is obvious to the person skilled in the art that the mechanical tuning apparatus and the pretuning means can also be different to what is presented above.

It is also obvious to the person skilled in the art that the safety brake device of an elevator presented above can be some other brake device gripping to the guide rails of the elevator car than the normal safety gear of the elevator.

The invention claimed is:

1. An elevator comprising:

an elevator car having a roof, the elevator car configured to travel along guide rails;

a safety brake device configured to stop unintended movement of the elevator car;

a transmission mechanism configured to activate the safety brake device if the transmission mechanism is activated, the transmission mechanism including an activation surface; and a tuning apparatus on the elevator car, the tuning apparatus configured to detect a presence on the roof of the elevator car, and to activate the transmission mechanism by moving a portion of a pretuning plate from a position not on top of the activation surface to a position on top of the activation surface if the presence on the roof of the elevator car has been detected.

2. The elevator according to claim 1, wherein the tuning apparatus comprises:

a tread base on the roof of the elevator car, the tread base configured to be movable with relation to the elevator car by a weight of a person on the tread base; and a detector configured to detect a height position of the tread base relative to the elevator car.

3. The elevator according to claim 2, wherein the tread base is configured to, move in obliquely aligned guide grooves above the roof of the elevator car, rest supported on springs, and cover essentially a whole of the roof of the elevator car.

4. The elevator according to claim 2, wherein the detector includes a supervision switch in an air gap between the roof of the elevator car and the tread base and the supervision switch is configured to disconnect a safety circuit of the elevator if the tread base moves downwards such that the height position of the tread base is reduced.

5. The elevator according to claim 2, wherein the transmission mechanism is connected to the elevator car to travel along with the elevator car and to be movable in relation to the elevator car in a movement direction of the elevator car, the transmission mechanism further comprising:

an activation mechanism configured to create a bottom safety space in an elevator shaft by activating the transmission mechanism if the elevator car enters the bottom safety space in the elevator shaft; and the activation surface configured to create a top safety space in the elevator shaft by activating the transmission mechanism if the portion of the pretuning plate is in the position on top of the activation surface and the elevator car enters the top safety space in the elevator shaft.

6. The elevator according to claim 5, wherein in the transmission mechanism includes an elongated frame part, wherein the activation surface is on a top end of the elongated frame part.

7. The elevator according to claim 6, wherein the tuning apparatus is configured to activate the transmission mechanism moving the portion of the pretuning plate on top of the activation surface, the pretuning plate being arranged to be movable along with movement of the tread base, the portion of the pretuning plate being a bend in the pretuning plate adapted to not be in the position on top of the activation surface of the transmission mechanism if the tread base is not detected as displaced downwards, and to move to the position on top of the activation surface of the transmission mechanism to activate the transmission mechanism if the tread base is detected as descended downwards.

8. The elevator according to claim 7, wherein the elevator further comprises:

supervision switches configured to monitor a position of the pretuning plate.

9. The elevator according to claim 7, wherein the elevator further comprises:

a detent installed in a fixed manner on one of the guide rail of the elevator car, which detent is disposed at a height determined by a height position of the top safety space and above the tuning apparatus in such a way that when the pretuning plate is on top of the activation surface, the bend of the pretuning plate is on a vertical line below the detent.

10. The elevator according to claim 1, wherein the transmission mechanism is connected by a coupling member configured to move wedges of the safety brake device against the guide rails of the elevator car to lock the elevator car into a position.

11. A safety apparatus of an elevator, the elevator including at least an elevator car configured to travel along guide rails, the elevator car including a roof, and a safety brake device configured to stop movement of the elevator car, and a transmission mechanism configured to activate the safety brake device, the safety apparatus comprising:

a tuning apparatus on the elevator car, the tuning apparatus configured to detect a presence on the roof of the elevator car, and to activate the transmission mechanism by moving a portion of a pretuning plate from a position not on top of an activation surface of a transmission mechanism to a position on top of the activation surface of the transmission mechanism if the presence on the roof of the elevator car has been detected.

12. The safety apparatus according to claim 11, wherein the tuning apparatus additionally includes a tread base on top of the roof of the elevator car arranged to be movable by a weight of a person on the tread base, and a detector of a height position of the tread base.

13. The safety apparatus according to claim 12, wherein the tread base is configured to move in obliquely aligned guide grooves above the roof of the elevator car, rest supported on springs, and cover essentially a whole of the roof of the elevator car.

14. The safety apparatus according to claim 11, wherein the transmission mechanism is connected by a coupling member configured to move wedges of the safety brake device against the guide rails of the elevator car configured to lock the elevator car into a position.

15. The safety apparatus according to claim 11, wherein the transmission mechanism is connected to the elevator car to travel along with the elevator car and to be movable in relation to the elevator car in a movement direction of the elevator car, the transmission mechanism comprising:

an activation mechanism configured to create a bottom safety space in an elevator shaft; and the activation surface configured to create a top safety space in the elevator shaft.

16. The safety apparatus according to claim 15, wherein the transmission mechanism includes an elongated frame part, wherein the activation surface is on a top end of the elongated frame part.

17. A safety apparatus arrangement installable in an elevator, the elevator including an elevator shaft, guide rails inside the elevator shaft and an elevator car configured to run on the guide rails, the safety apparatus arrangement comprising:

a safety brake device configured to stop movement of the elevator car; and a transmission mechanism configured to activate the safety brake device based on the transmission mechanism being activated and the elevator entering a safety space, the transmission mechanism including an activation surface extending in a first direction, the transmission mechanism being configured to be activated when a portion of a pretuning plate extending in a direction perpendicular to the first direction is moved from a position not on top of the activation surface to a position on top of the activation surface of the transmission mechanism.

18. The safety apparatus arrangement of claim 17, further comprising:

a tread base on top of the elevator car, the tread base configured to move downwards under a weight of a person; and a pretuning plate coupled to the tread base, the pretuning plate configured to activate the transmission mechanism, if the tread base moves downwards under the weight of the person.

19. The safety apparatus arrangement of claim 18 wherein the tread base is configured to, rest supported on springs, and cover essentially a whole of a roof of the elevator car.

20. The safety apparatus arrangement of claim 18 wherein the elevator car enters a safety space if the transmission mechanism moves in relation to the elevator car by a detent attached to the guide rails.

* * * * *